US005517921A

United States Patent [19]

Klohn

[11] Patent Number: 5,517,921

[45] Date of Patent: May 21, 1996

[54] RETRACTABLE STATION PLATFORM EXTENSION

[76] Inventor: Helmut Klohn, 685 Oak St., 13-1, Brockton, Mass. 02401

[21] Appl. No.: 408,554

[22] Filed: Mar. 21, 1995

[51] Int. Cl.[6] ..... B61B 1/00; E01F 15/00

[52] U.S. Cl. ..... 104/31; 14/71.1

[58] Field of Search ..... 104/30, 31; 105/436; 14/69.5, 71.1; 414/401; 114/362

[56] References Cited

U.S. PATENT DOCUMENTS

| | | | |
|---|---|---|---|
| 2,709,410 | 5/1955 | Fenton | 104/31 |
| 4,308,697 | 1/1982 | Guppy | 104/31 |
| 5,137,114 | 8/1992 | Tde et al. | 14/71.1 |
| 5,287,579 | 2/1994 | Estevez, Jr. | 14/71.1 |
| 5,418,993 | 5/1995 | Alten | 14/71.1 |

FOREIGN PATENT DOCUMENTS

| | | | |
|---|---|---|---|
| 1216199 | 5/1966 | Germany | 14/71.1 |
| 2852888 | 8/1980 | Germany | 14/71.1 |
| 238586 | 3/1969 | U.S.S.R. | 105/436 |

*Primary Examiner*—Robert J. Oberleitner
*Assistant Examiner*—S. Joseph Morano
*Attorney, Agent, or Firm*—Brian M. Dingman

[57] ABSTRACT

A pivoting, retractable platform edge extension for temporarily extending the upper surface of a fixed platform closer to train tracks, comprising a platform extension portion having an upper surface, the platform extension portion pivotably attached to the fixed platform such that the upper surface of the platform extension portion very closely meets and extends the support surface of the fixed platform when the extension portion is in a first, down position; at least one pivoting member fixed to the extension portion and extending underneath the fixed platform when the extension portion is in the first portion; and a pivot pin interconnecting the pivoting member and the fixed platform, the pivot pin adapted to rotate in at least one of the pivoting member and the fixed platform, to allow the extension portion to pivot about the pivot pin so that the extension portion can be moved to a second, retracted portion relative to the fixed platform; wherein the at least one pivoting member includes a cutout portion in which the upper surface of the fixed platform is received when the platform extension portion is in the second position to obviate the necessity for an opening in the upper surface of the fixed platform to receive the pivoting member when the platform extension portion is in the second position.

14 Claims, 9 Drawing Sheets

RETRACTABLE STATION PLATFORM EXTENSION

FIELD OF INVENTION

This invention relates to a pivoting, retractable train platform extension member that allows a single track to be used for both passenger and freight trains.

BACKGROUND OF INVENTION

Freight trains are typically wider than passenger trains. For stations to accommodate both types of trains, it is therefore necessary to effectively widen the passenger platform for passenger trains, so that the platform meets the train. Conversely, in order to allow freight trains to pass, the platform must be narrowed. One solution to this variable-width platform need is to attach a retractable platform edge extension to the fixed platform. Such platform edge extensions have been designed to pivot between a closed position, in which the extension is aligned with the platform edge, with its top closely matching and effectively continuing the top of the platform, and an open, or retracted, position, in which the platform extension is pivoted up to rest on the top of the platform, extending at just over 90° from the platform top.

The platform edge extension pivoting has been accomplished by including a number of spaced, protruding plates attached to the underside of the edge extension and extending under the platform when the edge extension is in the open position. That platform edge extension pivoting member plate is received in the center of a pair of spaced plates fixed to the underside of the fixed platform, with one of the fixed plates on each side and closely adjoining the edge extension pivoting plate. A bolt is passed through the two fixed plates and through a hole in the edge extension pivoting plate to provide an axis on which the platform edge extension can pivot.

Because this pivot axis is below the platform, the pivoting plate must be able to pass through the upper surface of the platform when the edge extension is pivoted from the open to the closed position. Accordingly, it has been necessary to cut slots in the platform which are a bit wider than the pivoting plate and aligned with the pivoting plate; this allows the plate to move through and above the platform during movement of the edge extension from the closed to the open position. There are typically three or four such pivoting-member receiving slots in the platform for every ten or fifteen foot section of the platform edge extension.

These slots partially defeat the objective of an absolutely safe platform. They present a tripping hazard, and an area in which objects such as wheelchair wheels and women's shoe heels can get caught. Additionally, the slots can become fouled with dirt and the like, making the pivoting operation of the platform more difficult. Since these platform extensions are balanced so that a single man can move a platform between the open and closed positions, this fouling can present a substantial impediment to proper platform extension movement. It is of critical importance that the extension be lifted before the passage of a freight train- if a platform extension is left in the closed position when a freight train passes, the impact can cause severe damage to the platform edge extension, the platform, and the train itself. Also, broken pieces of impacted platforms travelling through the station at extremely high speeds caused by the impact have been known to injure or kill passengers in the station. Accordingly, there exists a substantial need for such a pivoting platform extension which can pivot in the same fashion without the need for slots in the platform.

It would also be desirable to design platform extensions so that potential pedestrian hazard, damage to the sections, and damage to trains, is minimized if a platform is left in the closed position and is struck by a freight train. The rigid nature of the platform extensions has caused extensive damage to both the platform extension and the train in platform extension impacts which have occurred to date. Also, as mentioned above, pieces of the impacted platform can travel substantial distances from the impact site, causing pedestrian injury and additional station damage.

SUMMARY OF THE INVENTION

It is therefore an object of this invention to provide a pivoting, retractable platform edge extension.

It is a further object of this invention to provide such an extension which can pivot on an axis underneath the fixed platform without the need for any slots or exposed openings in the platform surface.

It is a further object of this invention to provide such an extension which is safer than existing platform edge extensions, both in use and when accidentally hit by a train.

It is a further object of this invention to provide such an extension which is easier to operate and less likely to be fouled than the existing platform edge extensions.

It is a further object of this invention to provide such an extension which is less-seriously damaged when struck by a train.

It is a further object of this invention to provide such an extension which causes less damage to a train when struck by a train.

This invention features a pivoting, retractable platform edge extension for temporarily extending the upper surface of a fixed platform to be closer to train tracks. These aims are accomplished without the need for the slots which are found in existing platforms which carry pivoting, retractable platform edge extensions. Additionally, the pivoting, retractable edge extension of this invention is less-severely damaged when struck by a train, and causes less damage to a train when struck, than existing platform edge extensions. There is also less potential for pedestrian injury when the platform of this invention is struck.

The platform edge extension includes a platform extension portion which has an upper surface that very closely meets and extends the upper surface of the fixed platform when the extension portion is in a first, down (closed) position. The platform extension portion is pivotably attached to the fixed platform through at least one pivoting member fixed to the extension portion and extending underneath the fixed platform when the extension portion is in the open position. There is a pivot pin interconnecting each such pivoting member to the fixed platform. The pivot pins are adapted to rotate in at least one of the pivoting member and the fixed platform to allow the extension portion to pivot about the pivot pins so that the extension portion can be moved to a second, retracted (open) position relative to the fixed platform. In order to accommodate a pivot axis which is underneath the fixed platform, each pivoting member includes a cut out portion in which the upper surface of the fixed platform is received when the platform extension portion is in the closed position to obviate the necessity for the opening in the upper surface of the fixed platform which is currently provided to receive the pivoting member when the platform extension portion is in the closed position.

The pivoting member in one embodiment includes a plate which is received between a pair of adjoining plates fixed underneath the surface of the fixed platform. The pivot pin may then include a bolt passing through a pivoting member plate and the two adjoining plates of the pair of plates, with the bolt rotatably received in a through hole in the pivoting member plate. This arrangement can also be used to lock the retractable platform edge extension in the closed position by including a protruding shoulder section on each of the pair of adjoining plates, and further including a platform extension locking pin which is adapted to sit on the shoulder sections and to pass through a pivoting member plate to lock the platform extension portion in the closed position.

The platform edge extension may further include a means for interlocking adjoining platform extension portions. This may be accomplished with a pivoting latch which includes a pivoting latch member on one platform extension portion, and a latch member receiving opening in the other platform extension portion. There may be a handle member on the pivoting latch member to facilitate its movement between a locking position in which it is in the receiving opening, and an unlocking position in which it is rotated back underneath the platform extension portion to which it is attached, so that each of the adjoining platform extension portions can be individually lifted to the closed position.

The platform edge extension may further include an impact-absorbing break-away outer extension section pivotably attached to the platform extension portion and having an upper surface which very closely meets and extends the upper surface of the platform extension portion. This outer extension section may include a support section comprised of a series of support members pivotably attached to the platform extension portion for pivoting about vertical axes, and an upper section attached to the support section. The upper section may include a plastic material that can break upon severe impact, for example a high-density foamed plastic material.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENT

Figure 1:
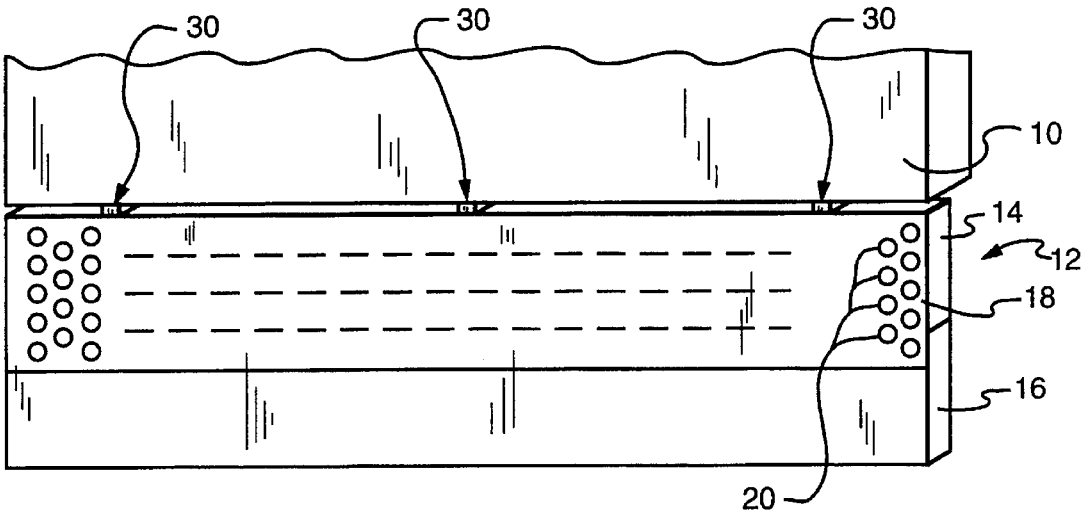
FIG. 1 is a simplified, top plan view of a pivoting, retractable platform edge extension according to this invention.

There is shown in FIG. 1 in simplified, schematic form, an embodiment of pivoting, retractable platform edge extension 12 according to this invention. Edge extension 12 is pivotably attached to fixed platform 10 by pivoting mounts 30. Platform edge extension 12 includes platform edge extension portion 14 having tactile surface 18 thereon with raised areas 20—such tactile surfaces are mandated by the Americans With Disability Act. Also shown in this embodiment is outer extension section 16 which is made of an impact-absorbing, break-away material which easily breaks up into small pieces upon severe impact. The small, relatively lightweight pieces of broken extension section material do not travel far, do not travel at high speed, and do not have a substantial amount of momentum as they leave the impact area. These features minimize the chance of pedestrian injury. Also, the entire platform edge extension is not ruined if it is struck by a train. This also minimizes the damage to the train upon impact.

A preferred embodiment of the pivoting, retractable platform edge extension of this invention is shown in detail in FIGS. 2 through 8. This embodiment is designed to be mounted to a fixed platform (either existing or new), and does not include the break away outer extension portion shown in FIG. 1 and 9. This embodiment uses a piece of wood as a rub rail on the track-facing edge instead.

The overall arrangement of pivoting, retractable platform edge extension 40 is as follows. The structural members may be aluminum, to minimize weight, and provide corrosion resistance. There is a fixed portion 42 which is mounted in or on the fixed platform. In this embodiment, portion 42 is a steel "T"-shaped member which is mounted to the top and face of concrete platform 11. For mounting to a new platform, portion 42 can be embedded within the cast platform. Tactile surface 43 is placed over the top of member 42. Retractable platform edge extension 40 is pivotably attached to the platform through a number of spaced pivoting members such as member 62 which is adapted to be pivotably connected to platform 11 through a pair of adjoining plates 61 and 265 which are welded to "T" 42. Retractable platform edge extension 40 is comprised of upper member 64 welded to channel members 63 and 65 with spaced plates 71 therebetween. Rub rail 41 is bolted to member 65. Tactile surface 66 covers member 64, which is chamfered at the edge meeting member 42 to minimize the gap therebetween. Fixed plates such as plate 61 include stiffening element 76 which help to maintain plate 61 normal to the vertical portion of member 42. Plate 61 includes through holes 72 and 73. The center of hole 73 becomes the pivot axis for the pivoting, retractable platform edge extension, as will become apparent below. Hole 72 is included to allow the passage of a locking pin which fixes the retractable platform edge extension in the closed position of FIG. 3 as well as in the open position of FIG. 7.

Pivoting member 62 is a plate with cutout 83 which is open to the top of the plate. Upper surface 43 of platform 11 is received in opening 83 when platform edge extension 40 is in the retracted, open position of FIG. 7. The underside of member 42 has a cavity machined therein to accept the upper end 79 of member 62. The cavity has a depth of only about one-half of the thickness of member 42 so that the upper surface of member 42 remains whole. Alternatively, the pivot point could be lowered so that end 79 of plate 62 is below the bottom of member 42, obviating the need for the machined slot.

Bolt 67 is passed through hole 73 in plate 61, hole 82 in plate 62, and an aligned hole, not shown, in plate 265. Bolt 67 is free to rotate within hole 82 to allow plate 62 to rotate about the longitudinal axis 101 of bolt 67.

Figure 3:
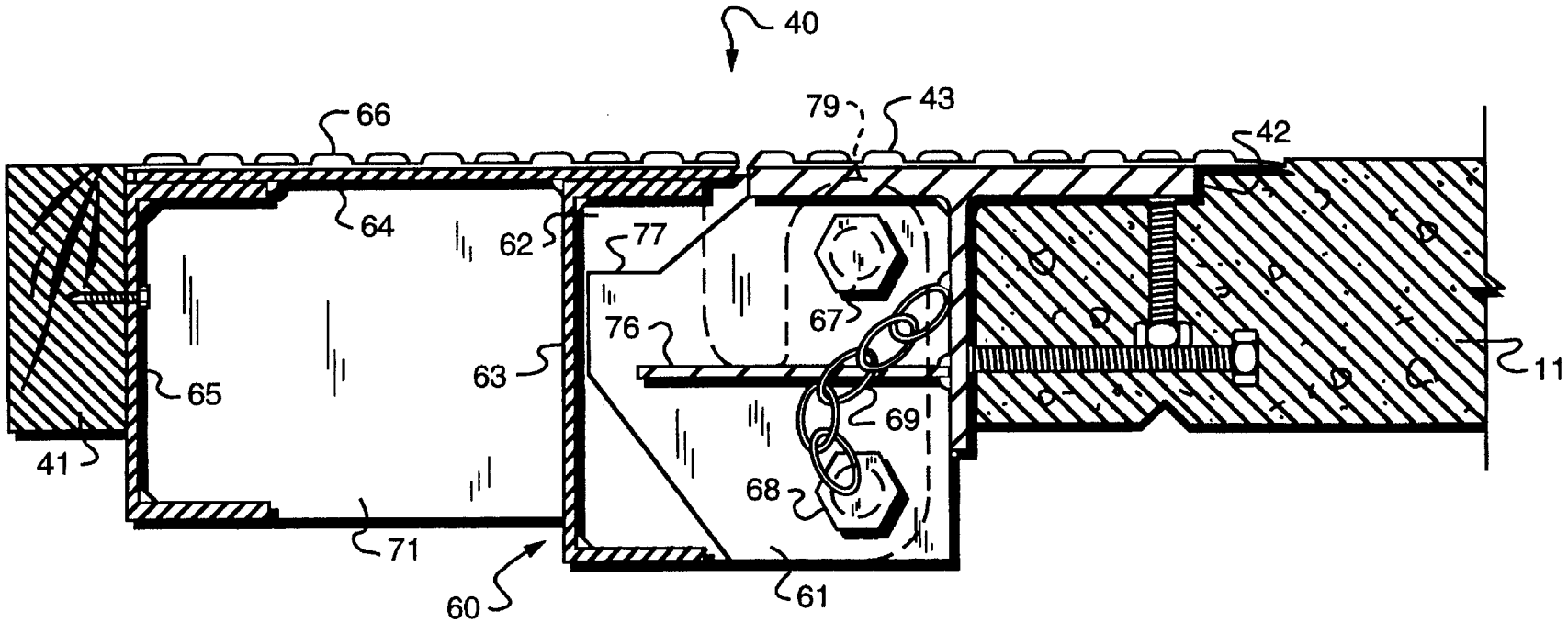
FIG. 3 is a cross sectional view taken along line A—A of FIG. 2, detailing the pivoting arrangement of the platform edge extension of this invention.
Figure 4:
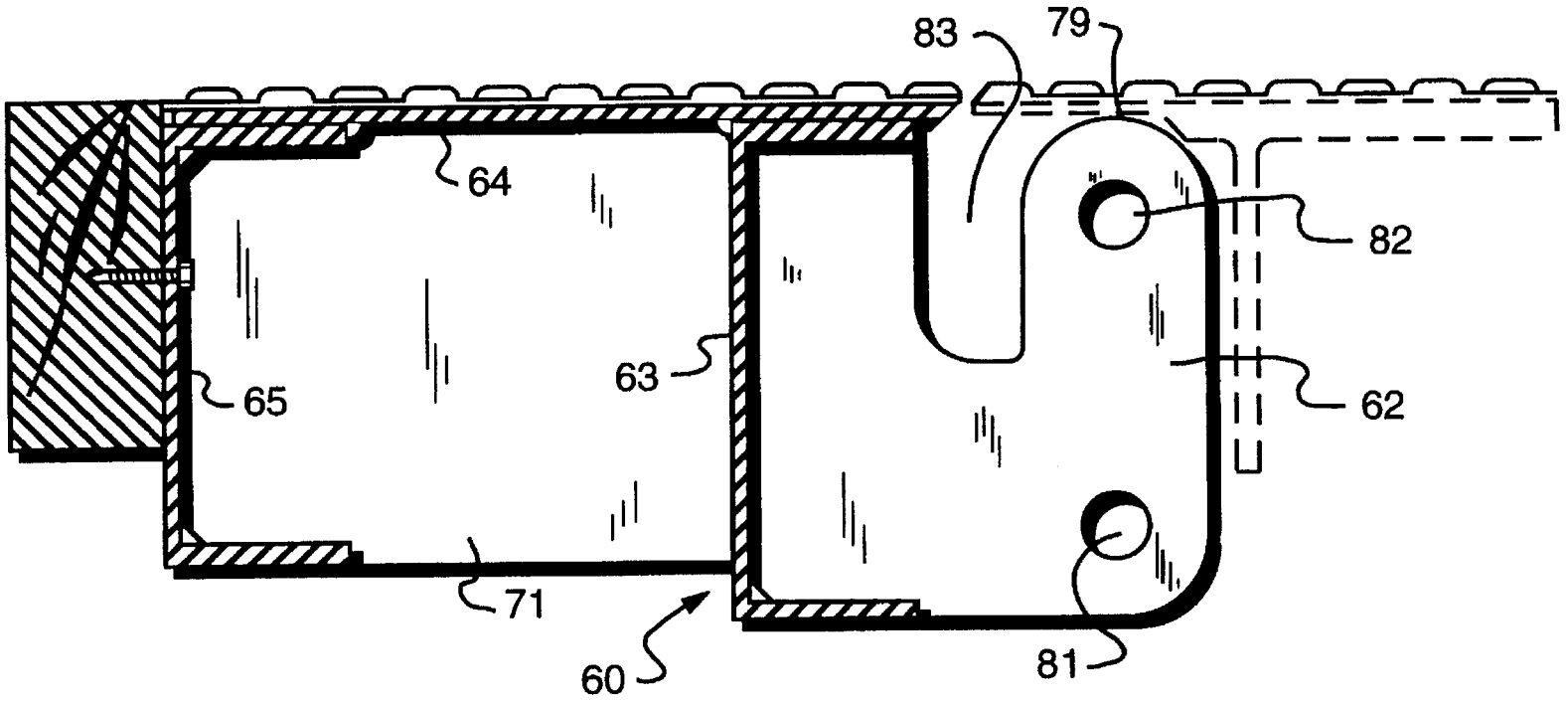
FIG. 4 is a view similar to FIG. 3 with a portion of the drawing removed to detail the pivoting member of this invention.
Figure 5:
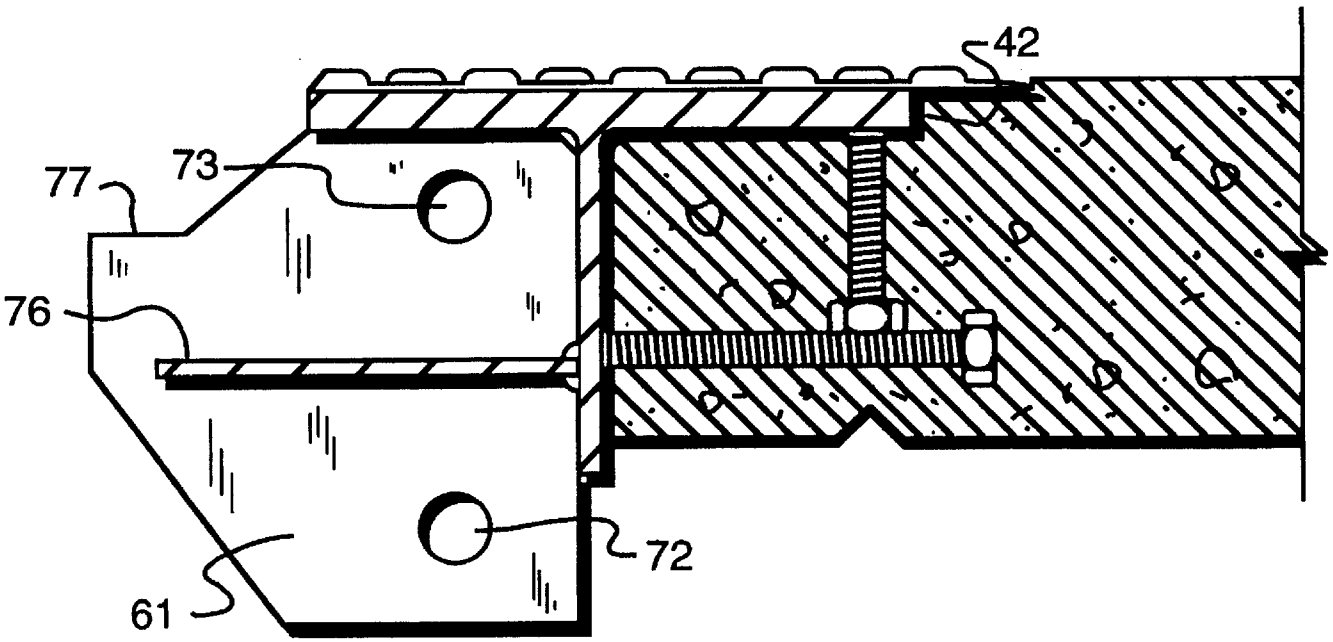
FIG. 5 is the portion of FIG. 3 removed from FIG. 4, detailing the preferred embodiment of the fixed members which form part of the pivoting mechanism of the platform edge extension.
Figure 8C:
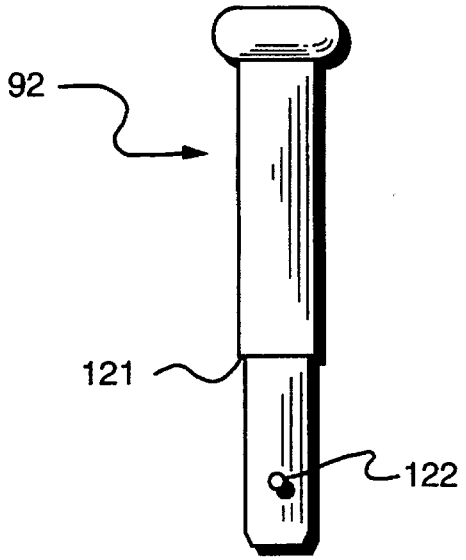
FIG. 8C is a detailed view of the latch handle for the edge latch of FIGS. 8A and 8B.
Figure 6:
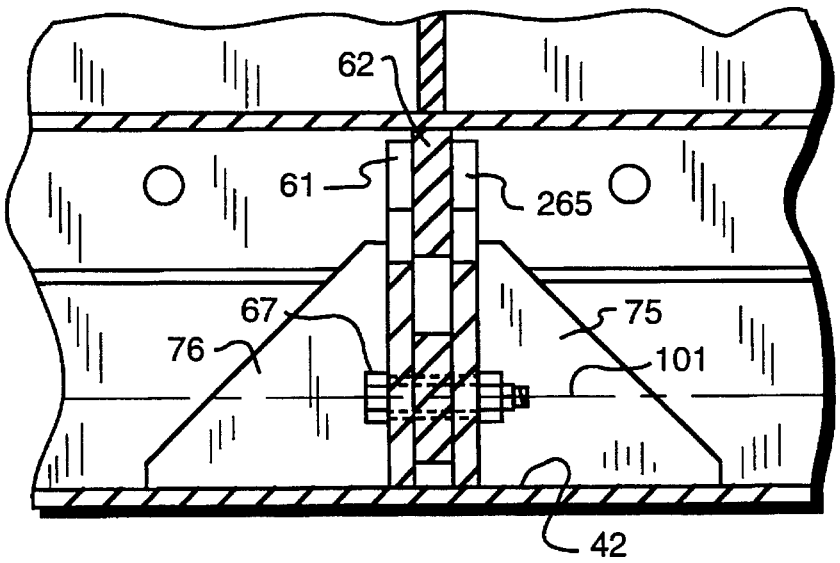
FIG. 6 is a more detailed view of the pivoting member.
Figure 7:
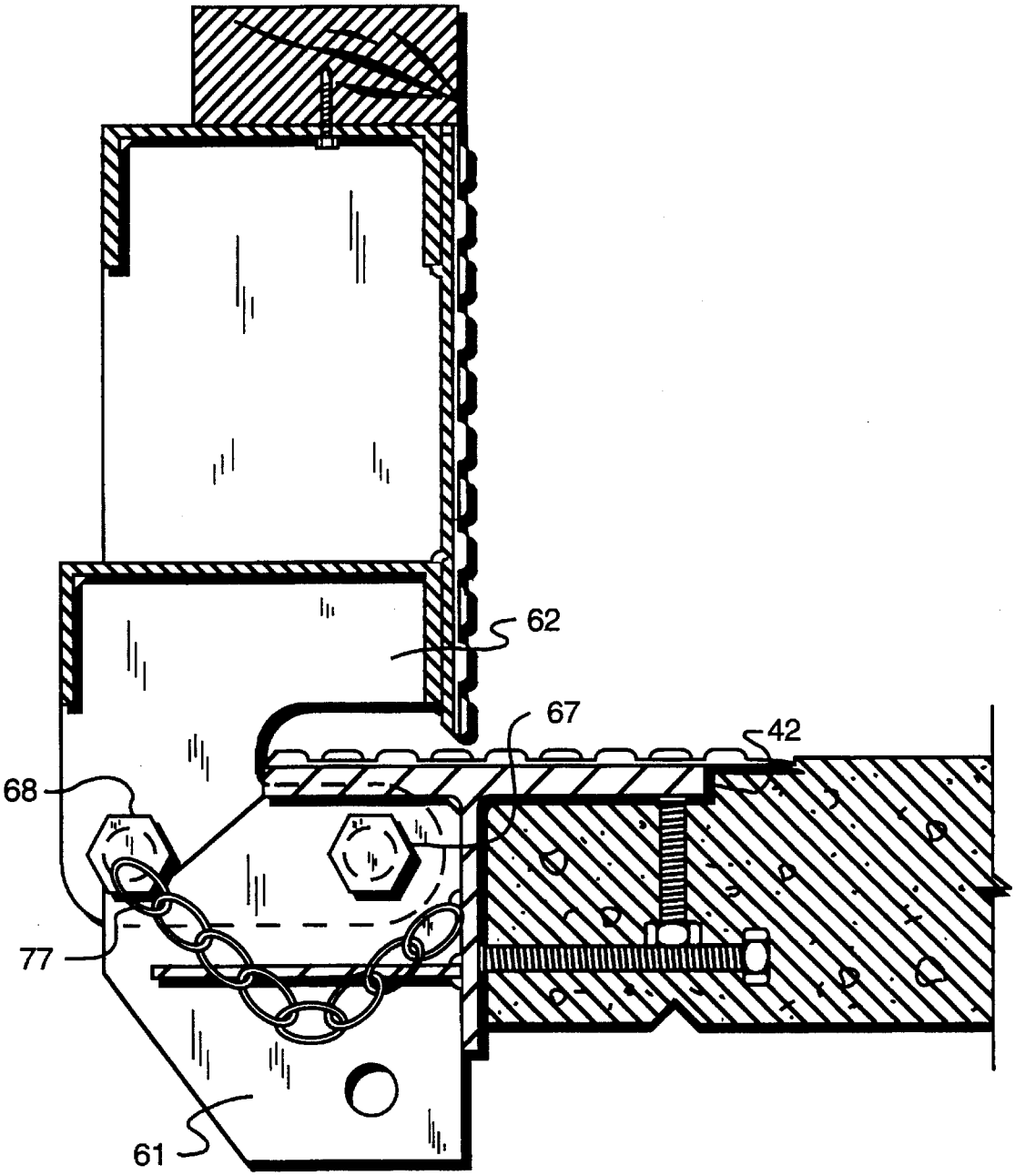
FIG. 7 is a view similar to that of FIG. 3 showing the edge extension in the open or retracted position.
Figure 8B:
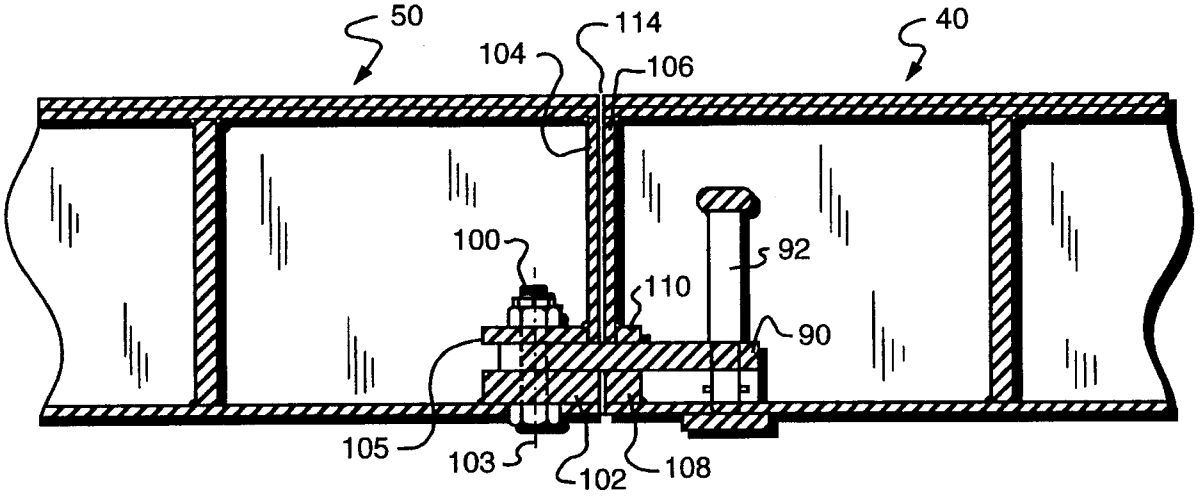
FIG. 8B is a front detailed view of the mechanism of FIG. 8A.
Figure 8A:
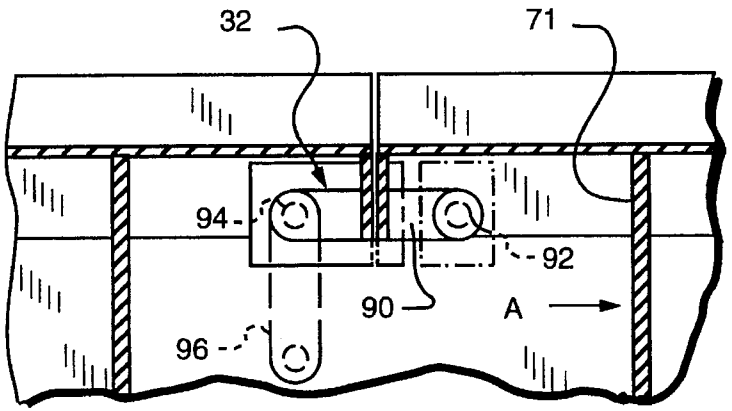
FIG. 8A is a partial cross sectional view of the preferred embodiment of a latch mechanism for interconnecting two adjacent platform edge extensions according to this invention.

To move the platform edge extension from the closed position of FIG. 3 to the open, retracted position of FIG. 7 in order to allow a freight train to pass, locking pin 68 is removed from holes 81 and 72 and the retractable platform edge extension 40 is lifted to the vertical position of FIG. 7. Pin 68 is then placed through hole 81 in plate 62, and rests on shoulder 77 of plate 61 and an identical shoulder, not shown, on the other plate 265 of the fixed pair of plates 61 and 265. Chain 69 is fixed to pin 68 and member 42 so that the pin is not lost.

Figure 2:
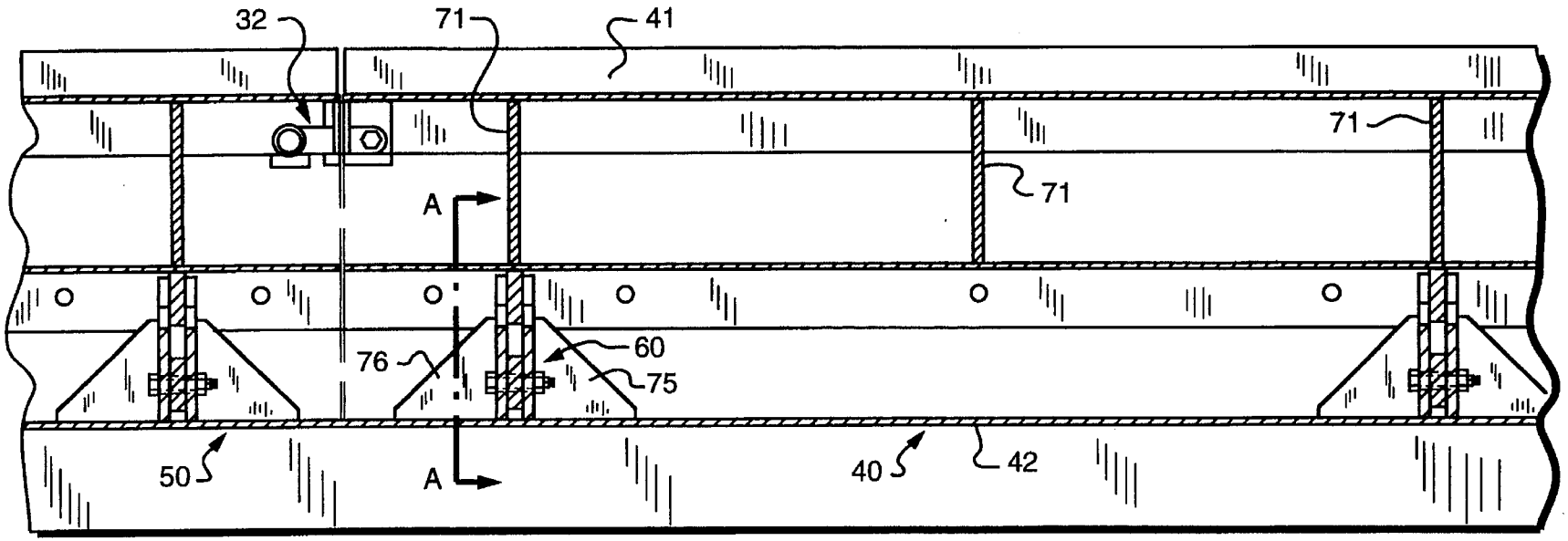
FIG. 2 is a top, cross sectional view of an embodiment of the pivoting, retractable platform edge extension of this invention which is designed to be anchored to a platform, and which is shown in greater detail in FIGS. 3 through 8C.

There is also provision for interlocking adjoining extension platform portions such as extension portions 40 and 50, FIG. 2. This is accomplished with a pivoting latch shown in FIGS. 8A through 8C. Latch 90 is part of retractable platform edge extension 50 and pivots about axis 103 of bolt 100 which passes through member 102 and member 105 that are fixed to the structure of platform edge extension 50. Latch 90 is adapted to pivot about axis 103 from the locking position in which it is engaged between fixed members 110 and 108 of second retractable platform edge extension 40, and an unlocked position shown in phantom by position 96, FIG. 8A, to allow each platform edge extension 40 and 50 to be moved individually. This latch assembly helps to fix adjoining retractable platform edge extensions together so that their adjoining upper surfaces closely match and are not misaligned, which reduces any tripping hazard. This misalignment between adjoining retractable platform edge extensions is also caused when the edge is struck repeatedly—successive units become slightly misaligned in both the vertical and horizontal directions, which can create potential tripping hazards as well as binding or jamming of successive units. The latching feature just described helps to maintain both vertical and horizontal alignment between successive units, and also structurally interconnects successive units so that there is less tendency to become misaligned when the leading unit is struck by a train. Handle 92 which includes shoulder 121 that rests on member 90 passes through member 90 to allow member 90 to be more easily pivoted about axis 103. Pin 122 prevents member 92 from being withdrawn from member 90.

Figure 9C:
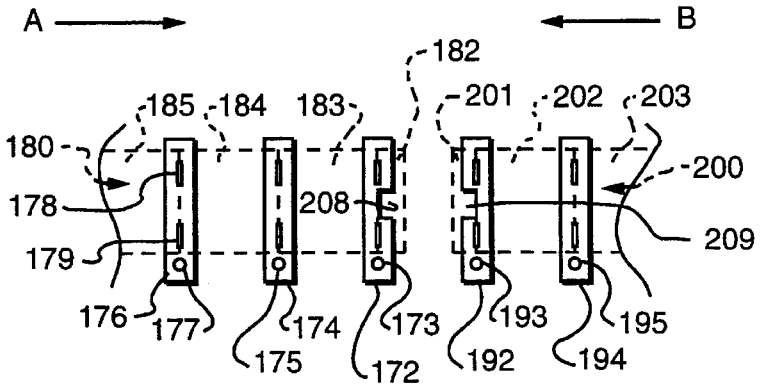
FIG. 9C is a partial top view of two adjacent edge extensions, detailing the two-way collapsible outer extension section of the preferred embodiment.
Figure 9B:
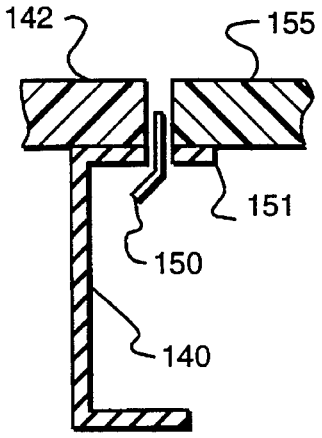
FIG. 9B is a cross-sectional view of a structural support and two break-away upper sections of FIG. 9A, detailing the manner in which the upper sections are held to the structural supports.
Figure 9A:
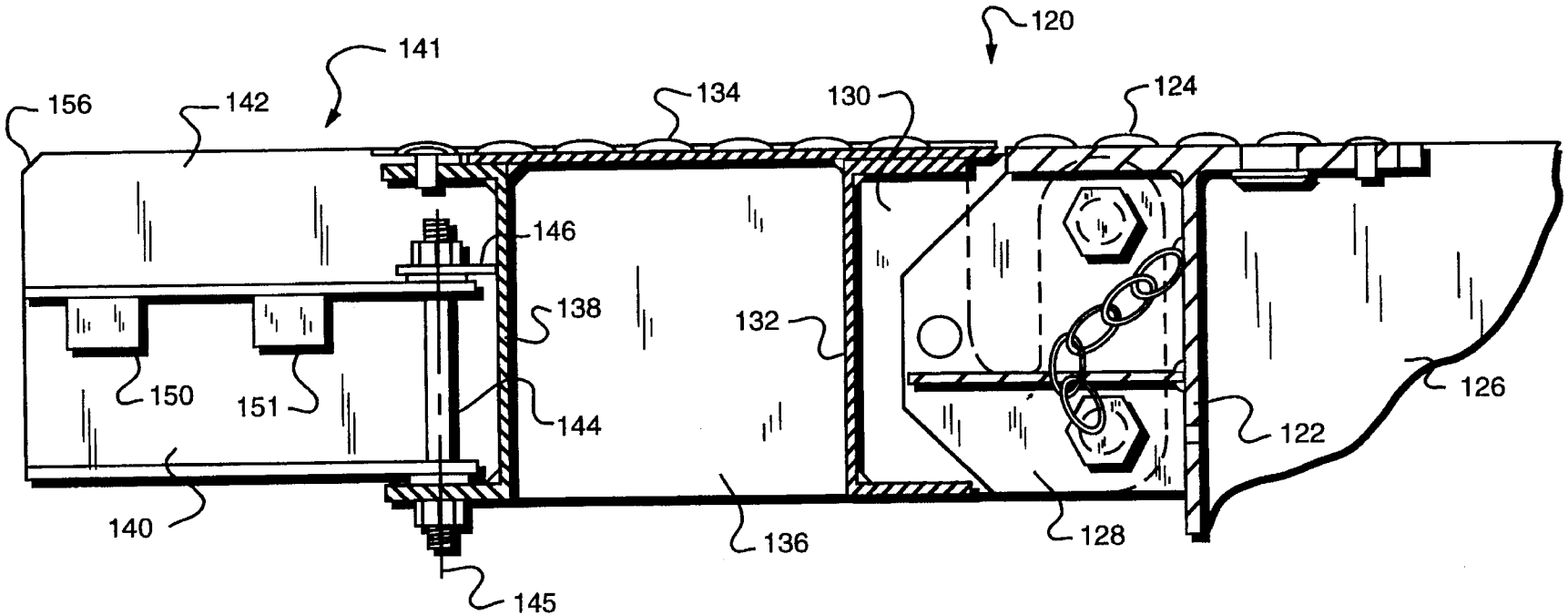
FIG. 9A is a cross sectional view of an alternative embodiment of the platform edge extension, which has a break-away, impact absorbing outer extension section pivotably attached to the platform extension portion.

Another feature which the pivoting retractable platform edge extension of this invention may include is an impact-absorbing, break-away outer extension section shown schematically in FIG. 1, and shown in detail in FIGS. 9A through 9C. Outer extension section 141 is pivotably attached to platform extension 120 as follows. The outer portion of extension 120 comprises channel member 138. A plurality of relatively short channels, such as member 140 are pivotably attached to member 138 at regularly-spaced locations (approximately 12" centers) along the length of member 138. Member 140 is adapted to pivot clockwise and counterclockwise about vertical axis 145 by including a fixed pivot pin 144 which passes through member 138 and plate 146 welded to member 148, and through a through hole in member 140, not shown. The upper section of impact-absorbing outer extension section 141 is comprised of foamed plastic member 142 that is fixed to members 140 by tabs such as tabs 150 and 151.

As shown in FIG. 9B, metal tabs such as tab 150 are placed between adjacent panels 142 and 155 of foamed plastic material. The sections are then glued together to hold them and tab 150 in place. The extension section is fabricated so that the joint between adjacent members 142 and 155 falls along the length of pivoting support channel member 140. Tab 150 is inserted through slot 151 in the upper portion of member 140 and slightly bent to hold the break-away, impact-absorbing foamed plastic upper sections of extension section 141 to its structural support. Having a number of relatively small panels such as panels 142 and 155, which may each be about 1' wide and as long as required to extend the platform edge extension from the fixed platform a desired distance, has several advantages. First, it provides a manner for adhering tabs such as tabs 150 and 153 to section 141 so that section 141 can be fixed to support members such as member 140. This also allows section 14 1 to be more easily replaced if it is struck by a train and damaged. Additionally, the smaller, glued sections tend to come apart when struck by a train, which decreases the size of the pieces of the platform which end up travelling through the station after impact, thus decreasing the likelihood of severe pedestrian injury.

The general arrangement of the impact-absorbing outer extension section, and the manner in which it is pivotably attached to the platform extension is shown in FIG. 9C. This figure shows one set of pivoting channel members 172, 174, and 176 that are each fixed to the outer channel member of one edge extension (not shown for clarity) at pivot points 173, 175 and 177, respectively. Similarly, a second set of pivoting members 192 and 194 are each pivotally attached to a second edge extension, also not shown for clarity, which is adjacent to the first edge extension as described above. Members 192 and 194 are pivotably attached by pivots 193 and 195, respectively. It should be understood that members such as members 172, 174, 176, 192 and 194 are identical to member 140, FIG. 9A. Only some of the pivoting members for the two adjacent edge extensions are shown, as this drawing is meant to illustrate the concept of the break-away outer extension section being pivotally attached so that the structural supporting members of the section pivot out of the way of a train when struck by a train, regardless of the direction in which the train is travelling when it strikes the section. To accomplish this, the channel support members such as member 172 and 192 which are at the end of one edge extension next to another edge extension must be able to pivot under the adjacent edge extension. To allow for this, slot 208 is cut through member 172, and slot 209 is cut through member 192. If the edge extensions are struck in the direction of arrow A, member 172 would pivot clockwise toward member 192, and pivot pin 193 would be received within opening 208 so that member 172 can lie flatter to inhibit damage to the train. Similarly, if a train travelling in the direction of arrow B strikes the edge extensions, member 192 will pivot counter clockwise toward member 172, and pivot pin 193 will be received in opening 209.

Also illustrated in this drawing is the foamed plastic panels which are placed on top of the pivoting support channel members. Foam section 180 is comprised of smaller foam panels 182 through 185. Foam section 200 is comprised of smaller foam panels 201 through 203. As described above in conjunction with FIG. 9B, the edges of the smaller panels lie along the lengths of two adjacent support channel members. For example, panel 184 lies along members 174 and 176. Two slots are cut through the upper portion of each pivoting member, as illustrated by slot 178 and 179 in member 176. This allows two tabs such as tab 150, FIG. 9B, to pass through each pivoting member to hold the foamed plastic panels in place on the pivoting members.

The break-away upper section panels such as panel 142 are preferably made of Ethafoam HS900, manufactured by Dow Chemical Company. This is a 9.5 $lb/ft^3$ closed cell hydrophobic polyethylene foam, which is strong enough to withstand the loads required in a platform, yet which can relatively easily break up upon impact by a train. This arrangement provides an outer extension section 141 which effectively pivots out of the way if impacted by a train. This allows the edge extension to be repaired after impact by simply pivoting members 140 back into place, and then attaching new upper section 142. Outer edge 156 may be chamfered as shown; this is the corner most frequently struck by trains. Chamfering lowers the chance of impact, thus decreasing maintenance costs.

The open ends of platform edge extensions 40 and 120 may be closed by an end plate (not shown) which is welded in place over each end. This improves the appearance by masking the structure of the edge extension. Also, this removes the hazard of a hand, foot or other object being caught in exposed cavities at the end of the edge extension. Finally, these end-plates add structural integrity which helps to reduce structural deformation caused by the extensive welding of the edge extension during its fabrication. This helps to maintain the overall shape of the edge extension over time, which increases the safety of the edge extension.

Also contemplated in the design, but not shown in the drawings, is the provision for automatic movement of the retractable edge extension of this invention as a train approaches the platform. This may be accomplished with a train-sensing switch, such as a pressure switch or optically-tripped switch, which is along the tracks at some distance from the station. A means for automatically moving the edge extension, for example a hydraulic or motorized lift, or a counter weight system, could be initiated when the sensor is tripped to raise the platform to the open position. Appropriate audible/visible warning signals would need to be provided at the platform to allow anyone standing on the edge extension to move off the extension before it was raised slowly to its open position. When the train passed, a second sensor downstream of the station could be used to engage the mechanism to return the edge extension to the down (closed) position.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A pivoting, retractable platform, system comprising:

a fixed platform having an upper surface;

a platform extension portion having an upper surface, said platform extension portion pivotably attached to the fixed platform such that said upper surface of said platform extension portion very closely meets and extends the upper surface of the fixed platform when said extension portion is in a first, down position;

at least one pivoting member fixed to said extension portion and extending underneath the fixed platform when said extension portion is in said first position; and a pivot pin interconnecting said pivoting member and the fixed platform, said pivot pin adapted to rotate in at least one of said pivoting member and the fixed platform, to allow said extension portion to pivot about said pivot pin so that said extension portion can be moved to a second, retracted position relative to the fixed platform;

wherein said at least one pivoting member includes a cutout portion in which the upper surface of the fixed platform is received when said platform extension portion is in said second position to obviate the necessity for an opening in the upper surface of the fixed platform to receive said pivoting member when said platform extension portion is in said second position.

2. The pivoting, retractable platform system of claim 1 in which said at least one pivoting member includes a plate.

3. The pivoting, retractable platform system of claim 2 in which the fixed platform includes a pair of adjoining plates for each said pivoting member plate, one of each of said adjoining plates on each side of said pivoting member.

4. The pivoting, retractable platform system of claim 3 in which said pivot pin includes a bolt passing through each pivoting member plate and the two adjoining plates of said pair of plates, said bolt rotatably received in a through hole in said pivoting member plate.

5. The pivoting, retractable platform system of claim 3 in which each plate of said pair of adjoining plates includes a protruding shoulder section to provide a means for maintaining said platform extension portion in said second portion.

6. The pivoting, retractable platform system of claim 5 further including a platform extension portion locking pin adapted to sit on said shoulder sections, and to pass through a said pivoting member plate, to lock said platform extension portion in said second position.

7. The pivoting, retractable platform system of claim 1 further including means for interlocking adjoining platform extension portions.

8. The pivoting, retractable platform system of claim 7 in which said means for interlocking adjoining platform extension portions includes a pivoting latch.

9. The pivoting, retractable platform system of claim 8 in which said pivoting latch includes a pivoting latch member on one platform extension portion, and a latch member receiving opening in the other platform extension portion.

10. The pivoting, retractable platform system of claim 9 in which said pivoting latch further includes a handle member on said pivoting latch member to allow movement of said pivoting latch member.

11. The pivoting, retractable platform system of claim 1 further including an impact-absorbing outer extension section pivotably attached to said platform extension portion and having an upper surface which very closely meets and extends said upper surface of said platform extension portion.

12. The pivoting, retractable platform system of claim 11 in which said outer extension section includes a support section of support members pivotably attached to said platform extension portion to pivot about vertical axes, and an upper section attached to said support section.

13. The pivoting, retractable platform system of claim 12 in which said upper section includes a plastic material that can break upon severe impact.

14. The pivoting, retractable platform system of claim 13 in which said plastic material includes foamed plastic material.

* * * * *